US010724254B1

(12) United States Patent
Troxell

(10) Patent No.: US 10,724,254 B1
(45) Date of Patent: Jul. 28, 2020

(54) WEDGE LEVELING SYSTEM

(71) Applicant: Ronald V. Troxell, Huntington Beach, CA (US)

(72) Inventor: Ronald V. Troxell, Huntington Beach, CA (US)

( * ) Notice: Subject to any disclaimer, the term of this patent is extended or adjusted under 35 U.S.C. 154(b) by 0 days.

(21) Appl. No.: 16/249,335

(22) Filed: Jan. 16, 2019

(51) Int. Cl.
*E04F 21/00* (2006.01)
*E04F 21/22* (2006.01)

(52) U.S. Cl.
CPC ..... *E04F 21/0092* (2013.01); *E04F 21/22* (2013.01)

(58) Field of Classification Search
CPC ..... E04F 21/0092; E04F 21/22
See application file for complete search history.

(56) References Cited

U.S. PATENT DOCUMENTS 7,992,354 B2 8/2011 Doda, Jr.
8,671,628 B2 3/2014 Sighinolfi
8,800,246 B2 * 8/2014 Gorton ..... E04F 21/0092 52/747.11
9,534,403 B2 * 1/2017 Biec ..... E04F 21/0092
2019/0169863 A1 * 6/2019 Torrents Comas ..... E04F 13/0892

* cited by examiner

*Primary Examiner* — Patrick J Maestri
(74) *Attorney, Agent, or Firm* — Kirk A. Buhler; Buhler & Associates Patenting

(57) ABSTRACT

A levelling system for aligning surface coverings includes a tab with a substantially flat base and a vertical member extending away from a central area of the top surface of the base. The base includes beveled feet portions on opposite sides thereof to allow it to be more easily inserted under lower surfaces of adjacent surface coverings, with the vertical member extending between opposed edges or ends of the tiles. The vertical member is attached to the base by reduced width frangible leg portions held in rounded openings, below the top surface of the base. The vertical member includes an opening spaced so as to be above two adjacent tiles when the tiles are placed on the base on either side of the vertical member. When a wedge is inserted and held in the opening and presses down, the tiles are pushed downwardly toward a surface upon which they are being laid to properly align the edges thereof until the tiles are set, the wedge removed and the vertical member broken off at the frangible leg portions.

16 Claims, 4 Drawing Sheets

WEDGE LEVELING SYSTEM

BACKGROUND OF THE INVENTION

1. Field of the Invention

This invention generally relates to a wedge leveling system for laying tile and other surface protective coverings on a surface and more specifically to a tab for use with a wedge to prevent misalignment or lippage of tiles and the like when being laid on the surface.

2. Description of the Prior Art

Many tile and surface protective covering spacing and leveling devices and methods for using the same are known. Examples of such devices and methods are set forth in U.S. Pat. Nos. 7,992,354, 8,671,628 and 8,800,246. These prior art devices and methods for aligning tile and ensuring the edges of adjacent tiles are levelled include levelling devices having a base which is placed below the lower surfaces of two adjacent tiles. The base has a vertical member extending upwardly therefrom and inserted between side edges of the two tiles. The vertical member includes an opening therein and is attached to the base by one or more frangible connections in various positions on the vertical member. The frangible connections are broken or snapped off after the adhesive holding the tiles is set and the wedge is removed, to remove the vertical member from between the tiles.

These known devices all use wedges that are inserted through the opening in the vertical member to press against the upper surfaces of the two tiles and push the tiles down against the surface on which they are being laid, to hold the tiles aligned and in place until set. These known devices tend to be expensive to use, have frangible connections in or above the base at different positions in relation to the side edges of the two tiles and do not always provide acceptable and consistent results without the use of additional spacers or other devices or tools.

Therefore, there still exists a need in the art for an improved wedge leveling system and the levelling device or tab used with the wedge to maintain the items being attached to a surface in place and in proper alignment, and which is easily broken off at a frangible connection, in the desired position, below the upper surface of the base to provide more consistent and improved results.

The wedge leveling system of the present invention is configured to allow tiles or the like to be easily mounted on opposite sides of the base of the levelling device, with a vertical member held between opposed edges of the tiles. A wedge is then inserted and tightly held in an opening in the vertical element, so as to maintain the tiles or the like in place until set, whereby the wedge may be used to break off the an upper protruding portion of the levelling device extending between adjacent tiles or the like or the wedge is removed and the upper protruding portion of the levelling device is easily broken off by kicking or striking with a tool.

SUMMARY OF THE INVENTION

The levelling system of the present invention will hereinafter be described solely in relation to its use with tiles. However, it is to be understood that the levelling system may be used with substantially any floor, wall or other surface to which a surface coverings or cladding material is to be applied.

The levelling system of the present invention provides many advantages including, but not limited to the following:

1) Minimizes the number of separate spacer and/or tab devices that must be used.

2) The tab of the levelling system is preferably made from a thermoplastic material and includes a base and a vertical member extending away from a central area of a top surface of the base. The base of the tab is readily inserted between adjacent tiles with the vertical member extending between opposed edges or ends of the tiles. The base may take any desired shape, but preferably includes spaced apart outer ends or feet which are beveled to allow the base to be more easily inserted under adjacent tiles on the surface to which the tiles are being laid.

3) The tab includes a first opening formed between two leg portions of the vertical member, as well as a second opening on the top portion. The leg portions have rounded lower ends attached to frangible elements held in the bottom of curved openings formed on the top surface of the base. The frangible elements include small openings therein so as to be easily broken off below the top surface of the base, eliminating separation in the wrong location, after the tiles are set, by either rocking or striking the vertical member.

3) In one embodiment of the invention the tab may be provided with a knife edge on the top of the opening in the vertical member to more firmly and securely cooperate with grooves or ribs formed on an angled top surface of a wedge when inserted and held in the opening.

Accordingly, it is a general object of the present invention to provide an improved tile levelling system. It is a more particular object of the present invention to provide a tile leveling system with a levelling device or tab having an opening therein into which a wedge is inserted and held to press on the upper surfaces of adjacent tiles to properly align the edges thereof. It is a further object of the present invention to provide a tile leveling system with a tab having a base with a vertical member having at least one opening therein, which vertical member is connected to the base by spaced legs having frangible lower portions. It is yet another object of the present invention to provide a tile leveling system with a tab that includes a wedge holding opening therein. It is a still further object of the present invention to provide a novel tile leveling system with a tab having an integrated design that is more diverse, easier to use, uses less material to make and which eliminates breaking away of the frangible lower portions in the wrong locations, when compared to available tile levelling devices.

In accordance with one aspect of the present invention there is provided, a levelling system comprising a tab having a base and a vertical member releasably attached to the base by frangible leg portions held in openings formed on a top surface of the base. The vertical member includes an opening formed between the leg portions and spaced so as to be above two adjacent tiles when the tiles are placed on the base on either side of the vertical member, which extends between adjacent ends or side edges of the tiles. When a wedge is inserted and held in the opening and presses down, the tiles are pushed downwardly toward a surface upon which they are being laid to properly align the edges thereof until the tiles are set. The wedge is then used to break off the vertical member, or the wedge is removed and the vertical member broken off at the frangible portions and removed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
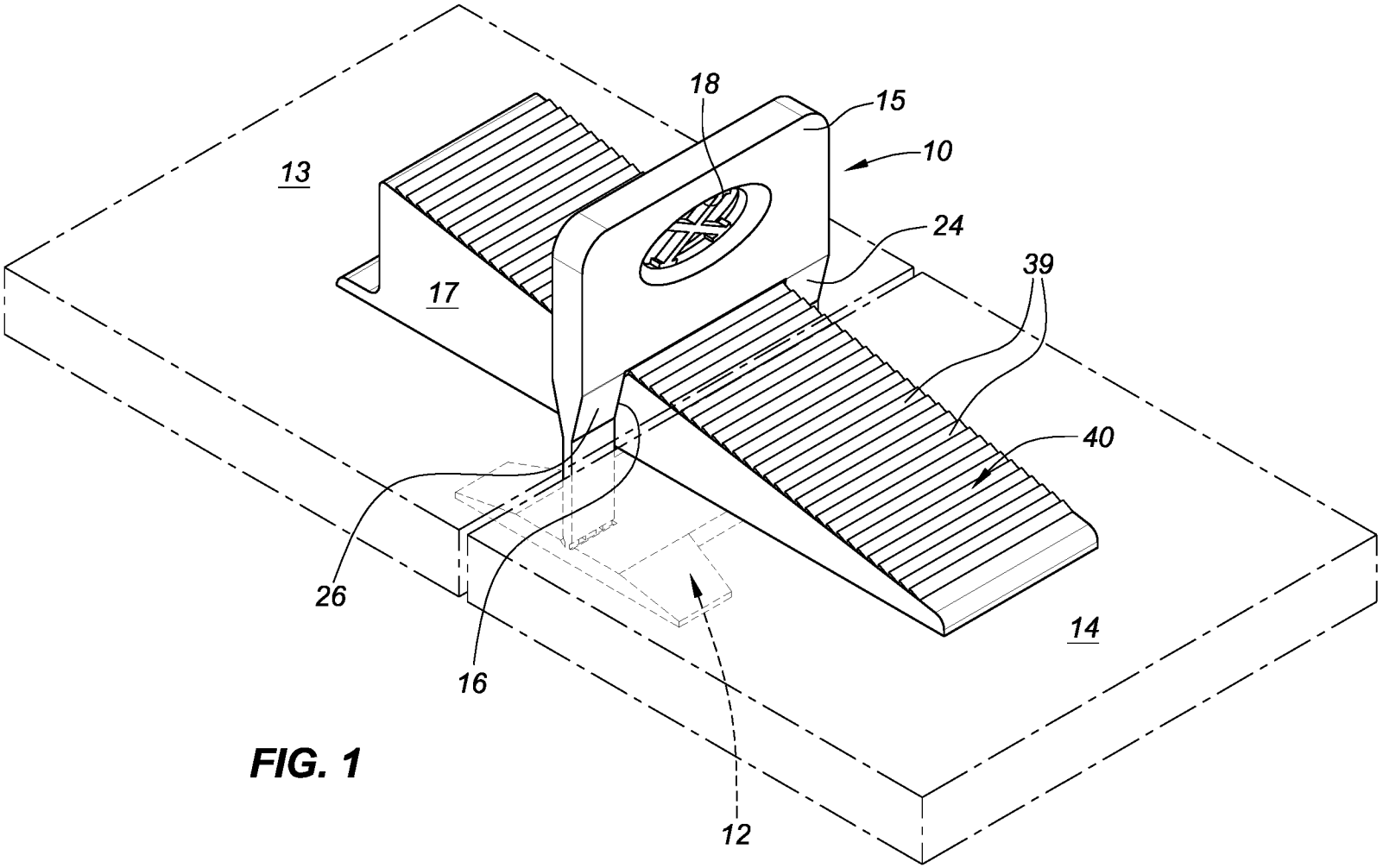
FIG. 1 is a perspective view, looking from above, showing two tiles having a tab of the present invention with a base inserted under adjacent ends or side edges and a vertical member extending from the base between the ends or side edges of the tiles; a wedge is inserted and held in an opening formed through the vertical member and presses down on the top surfaces of the two tiles so as to align the edges and upper surfaces of the tiles.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a tile levelling system having an improved tab for insertion between two adjacent tiles so as to both space the tiles apart and cooperate with a wedge inserted into an opening in a vertical member of the tab to align the edges of the two tiles.

Turning now to the drawings, there illustrated is a preferred embodiment of a levelling device or tab 10 having a base 12 for mounting on a surface or substrate (not shown) under adjacent tiles 13, 14, with an adhesive or thinset applied to the surface to be covered and the lower surfaces of the tiles. The tab 10 includes a vertical member 15 secured to the base with a first opening 16 in the vertical member adapted to receive a wedge 17, as described more fully below. The vertical member 15 may also include a second beveled opening 18 on a top portion thereof for easier handling and insertion under tiles, reduced material requirement and to provide product recognition, such as a logo or identifying symbol. This top portion is also preferably expanded or thicker to provide additional rigidity when inserting the tab 10, thereby preventing bending or breaking.

As shown more clearly in FIGS. 2-6, 8 and 9, the base 12 includes an upper surface 19 and a lower surface 20, with spaced apart legs or feet with beveled top surfaces 21 on portions of the base extending outwardly from either side of the vertical member 15. Openings 22 are formed in the base between the beveled legs or feet 21 (see FIGS. 2-5). The openings 22 allow the adhesive or thinset used on the surface being covered and the undersurfaces of the tiles 13, 14 to access both sides of the base to provide better adhesion and to eliminate bonding gaps that cause tile breakage. Additionally, the openings 22 provide lighter weight, less material used and faster mold cooling when fabricating from a plastic, or the like.

Figure 2:
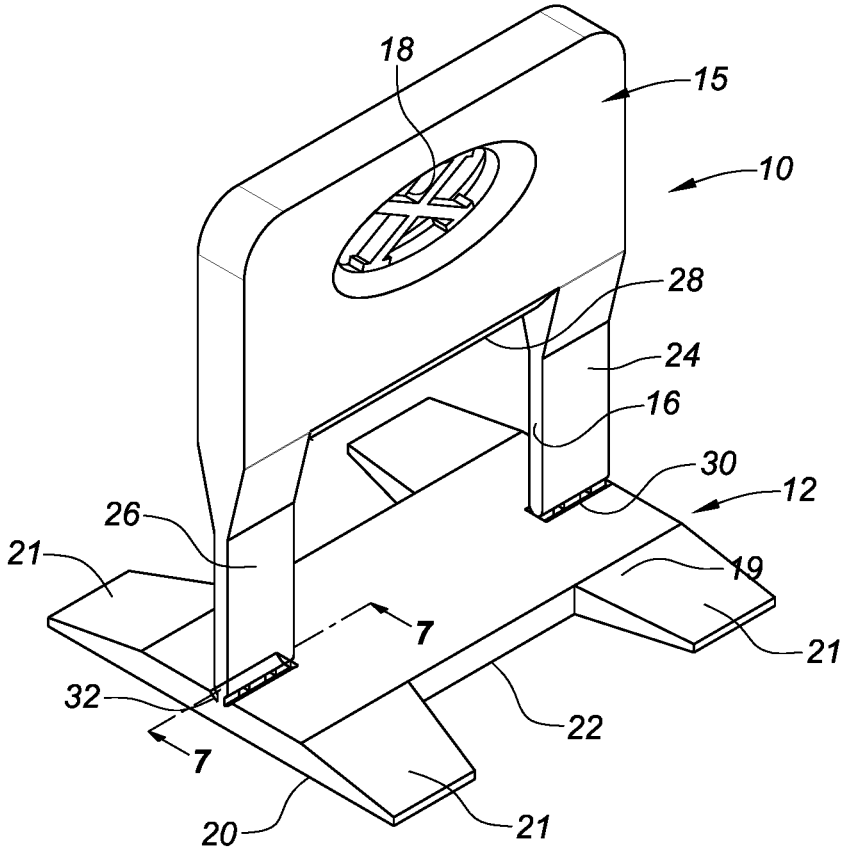
FIG. 2 is a top perspective view of a preferred embodiment of the tab of the present invention.
Figure 3:
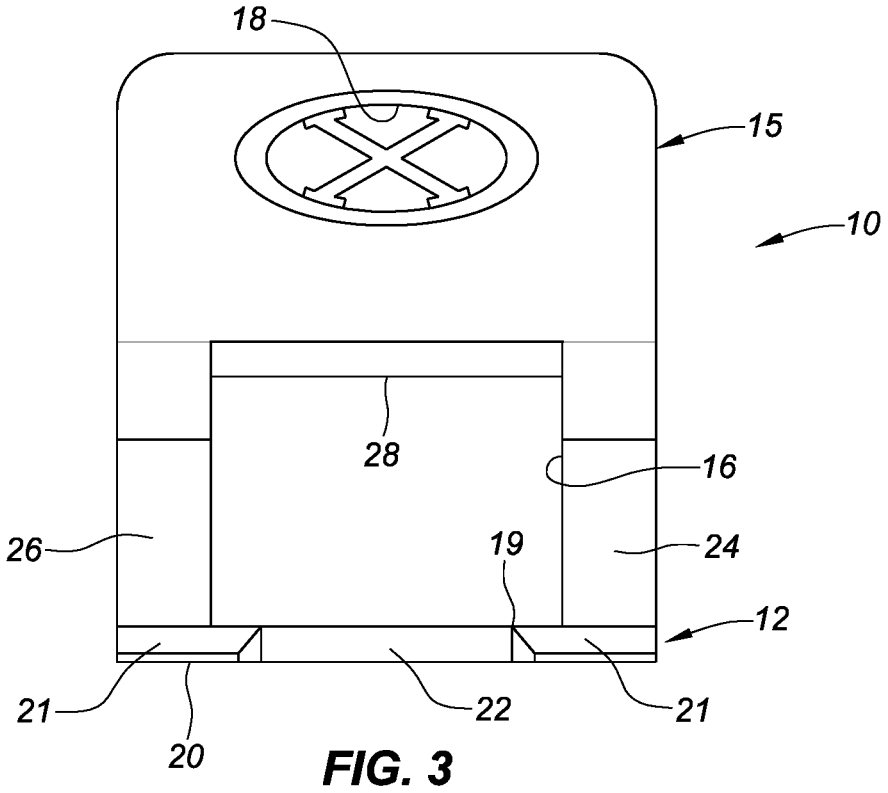
FIG. 3 is a front view of FIG. 2; with the rear view being substantially identical thereto.
Figure 4:
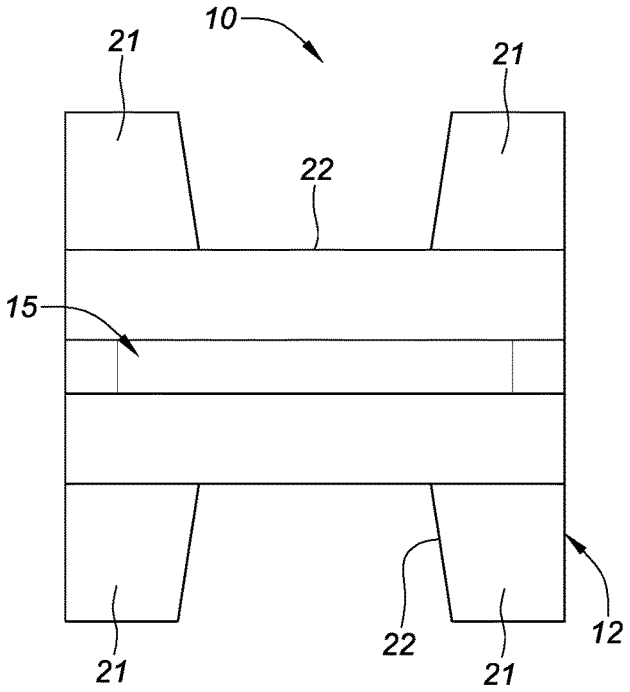
FIG. 4 is a top plan view of FIG. 2.
Figure 5:
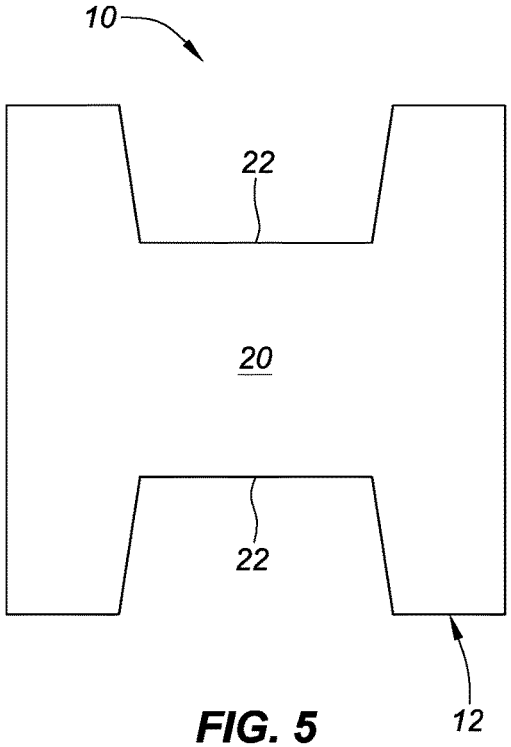
FIG. 5 is a bottom plan view of FIG. 2.
Figure 6:
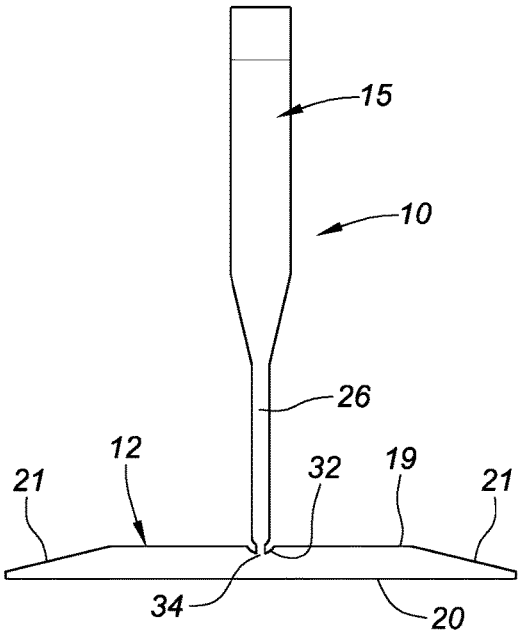
FIG. 6 is a side elevational view of a first side of FIG. 2, the other side being identical thereto.
Figure 7:
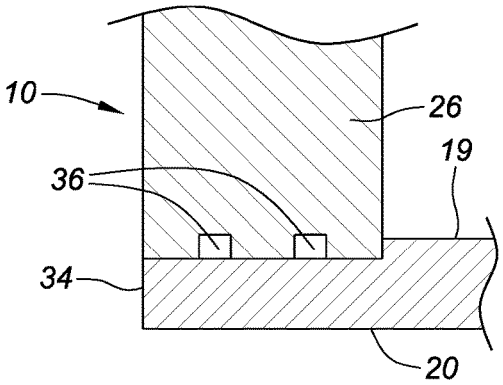
FIG. 7 is sectional view of a frangible connection of a leg of the vertical member to the base of FIG. 2, taken along line 7-7 of FIG. 2.
Figure 8:
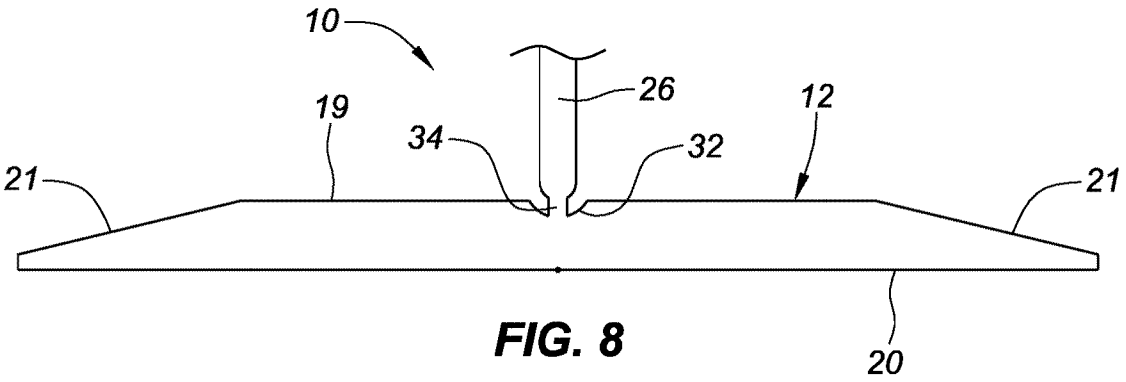
FIG. 8 is an enlarged partial side view of the frangible connection of a leg of the vertical member to the base shown in FIG. 6.

As best shown in FIGS. 1-3, the vertical member 15 has the first opening 16 formed therein between two leg portions 24, 26 and an upper edge 28. The inner or lower ends of the legs 24, 26 are held in aligned openings 30, 32 formed in the upper surface 19 of the base approximately along the centerline thereof by reduced width frangible portions 34. In a preferred embodiment, the openings 30, 32 are curved or rounded in profile.

As best shown in FIGS. 6-9, the reduced width frangible portions 34 are formed below rounded ends 38 of the legs 24, 26 and have a plurality of openings 36 extending therethrough to allow the frangible portions to be more easily broken off, in the desired position, near the bottoms of curved openings 30, 32, when rocked or sufficient force is applied from either side of the tab 10, against the vertical member 15. In one embodiment of the invention there are two openings 36 in the frangible portions 34.

Figure 9:
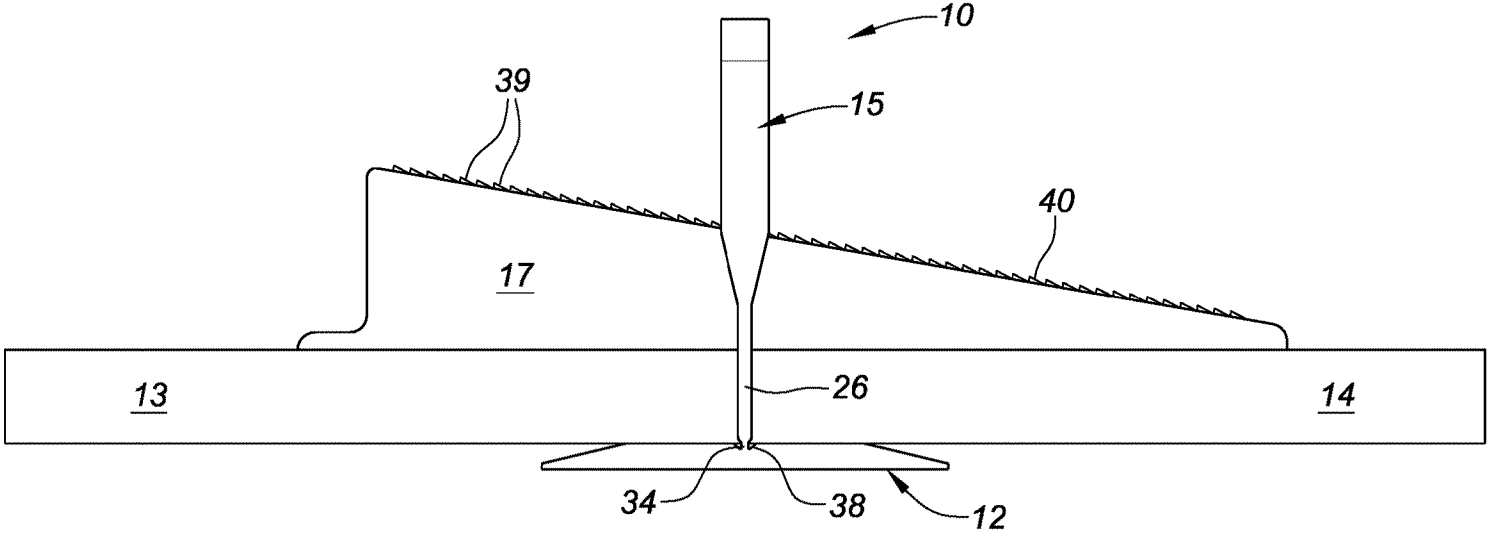
FIG. 9 is a side elevational view of a first side of FIG. 1, the other side being identical thereto.

In use, as best shown in FIGS. 1 and 9 of the drawings, the tab 10 has its base 12 placed on a surface (not shown), such as floor or wall, with the beveled legs or feet 21 of the base under the lower surface of the tiles 13, 14 and with sufficient adhesive or thinset applied to the lower surface of the tiles and the surface to be covered by the tiles to allow the adhesive or thinset to enter the break point area and aid in holding the tab in place. The vertical member 15 is placed so as to extend upwardly between opposed ends or side edges of the tiles, to properly space the tiles apart and to allow the opening 16 to receive the wedge 17 above the top surfaces of the adjacent tiles. The wedge is forced into the opening 16 until grooves or ribs 39, formed on an upper angled surface 40, engage with and lock with the upper edge 28 of opening 16. In one embodiment of the invention the upper edge 28 may be formed as a knife edge (FIG. 3) to more securely hold the wedge in position by cooperating with grooves or ribs 39 and, therefore, more firmly press down on the top surfaces of tiles 13, 14 so as to align the opposing edges and prevent misalignment or lippage. It is to be understood that sufficient adhesive is placed on the lower surface of the tiles and the surface to be covered, to enable some of the adhesive to enter the openings 22 and flow onto the top 19 of the base 12 to aid in holding the base on the supporting surface.

After the adhesive holding the tiles and base in place sets, the wedge 17 is either removed or used to aid in breaking the vertical member 15 off in the base 12 by either hitting the wedge or removing the wedge and rocking the vertical member around the frangible portions 34 or hitting the upper end of the vertical member, above the top surface of the tiles, with a hammer or other tool, or by kicking the wedge and/or vertical member. The reduced width frangible portions 34 below rounded ends 38 of the legs 24, 26 are broken off along the plurality of openings 36, essentially at or near the bottom of the rounded openings 30, 32. The rounded openings 30, 32 and rounded ends 38, as well as the openings 36, allow the frangible portions 34 to be broken off, in the correct location, at or near the bottom of the openings 30, 32, well below the surface 19 of the base. After the vertical member is broken off and removed, the space between the tiles is filed with grout. The grout also fills in the now empty rounded openings in the base 12 to aid in keeping the base in position underneath the lower surface of the tiles.

It, therefore, can be seen that the present invention provides an improved levelling system comprising a tab having a base and a vertical member releasably attached to the base by frangible leg portions having a plurality of openings formed therein and held in rounded openings formed on the top surface of the base. The vertical member includes an opening spaced so as to be above two adjacent tiles when the tiles are placed on the base on either side of the vertical member which extends between adjacent ends or side edges of the tiles to aid in spacing the same. A wedge having an angled top surface with a number of grooves or ribs may then be inserted and more securely held in the opening to press down the tiles toward a surface upon which they are being laid to properly align the edges thereof until the tiles are set, the wedge removed and the vertical member broken off.

Those skilled in the art will appreciate that various adaptations and modifications of the just-described preferred embodiment may be configured without departing from the scope and spirit of the invention. Therefore, it is to be understood that, within the scope of the appended claims, the invention may be practiced other than is specifically described herein.

What is claimed is:

1. A wedge leveling system for aligning surface coverings, comprising:

a tab having a flat base with a bottom surface and a top surface;

a vertical member frangibly secured in the top surface of the base along a central area;

said base including beveled feet portions extending from opposite sides of the vertical member adapted to be inserted under lower surfaces of adjacent surface coverings to be aligned, with the vertical member extending between opposed edges or ends of said adjacent surface coverings to be aligned;

said vertical member being attached to the base by leg portions having rounded lower ends secured to reduced width frangible portions held in rounded aligned openings below the top surface of the base;

at least one opening formed in said vertical member above the top surface of the base;

a wedge adapted to be inserted and held in the at least one opening in the vertical member where it will press down the adjacent surface coverings to be aligned toward a surface upon which they are being laid, to properly align the edges thereof until the adjacent surface coverings are set; and said reduced width frangible portions of the vertical member capable of being broken off, below the top surface of the base, when sufficient force is applied thereto.

2. The wedge leveling system of claim 1, wherein said base includes openings formed between the beveled feet portions.

3. The wedge leveling system of claim 1, wherein the reduced width frangible portions include a plurality of openings extending therethrough.

4. The wedge leveling system of claim 3, wherein there are two openings in the reduced width frangible portions.

5. The wedge leveling system of claim 1, wherein said vertical member includes a second opening formed therein for holding identifying matter.

6. The wedge leveling system of claim 1, wherein said wedge includes an angled top surface with a plurality of ribs formed thereon.

7. The wedge leveling system of claim 1, wherein the at least one opening formed in said vertical member includes a top knife edge adapted to cooperate with the plurality of ribs formed on the angled top surface of said wedge.

8. The wedge leveling system of claim 7, wherein the at least one opening has side edges formed by the leg portions of said vertical member.

9. A wedge leveling system for aligning surface coverings comprising:

a tab having a flat base with a bottom surface and a top surface;

a vertical member frangibly secured to the top surface of the base along a central area;

said base including beveled feet portions extending from opposite sides of the vertical member adapted to be inserted under lower surfaces of adjacent surface coverings to be aligned with the vertical member extending between opposed edges or ends of said adjacent surface coverings to be aligned;

said vertical member being attached to the base by a pair of leg portions having rounded lower ends attached to reduced width frangible portions held in rounded openings below the top surface of the base;

at least one opening formed in said vertical member above the top surface of the base having side edges formed by the leg portions of said vertical member and a top edge substantially parallel to the top surface of the base; and a wedge adapted to be inserted and held in the at least one opening in the vertical member where it presses down the adjacent surface coverings toward a surface upon which they are being laid, to properly align the edges thereof until the adjacent surface coverings are set; and said frangible portions of the vertical member capable of being broken off, below the top surface of the base, when sufficient force is applied thereto.

10. The wedge leveling system of claim 9, wherein there are two openings in the reduced width frangible portions.

11. The wedge leveling system of claim 9, wherein said vertical member includes an expanded top portion and a second opening formed therein for holding identifying matter.

12. The wedge leveling system of claim 9, wherein said wedge includes an angled top surface with a plurality of ribs formed thereon.

13. The wedge leveling system of claim 12, wherein the top edge of the at least one opening is formed as a knife edge for cooperating with the plurality of ribs formed on the angled top surface of said wedge.

14. A wedge leveling system for aligning surface coverings including:

a tab having a flat base with a bottom surface and a top surface;

a vertical member frangibly secured in rounded openings formed in the top surface of the base and extending along a central area;

said base including beveled feet portions extending from opposite sides of the vertical member adapted to be inserted under lower surfaces of adjacent surface coverings with the vertical member extending between opposed edges or ends of said adjacent surface coverings and the beveled feet portions having openings formed through the top surface of the base between the beveled feet portions;

said vertical member being attached to the base by a pair of leg portions having rounded ends with reduced width frangible portions held below the top surface of the base; the reduced width frangible portions being secured to the rounded ends of the leg portions and include a pair of openings extending therethrough;

a first opening formed in said vertical member above the top surface of the base having side edges formed by the leg portions of said vertical member and a top edge substantially parallel to the top surface of the base; and said reduced width frangible portions of the vertical member capable of being broken off, below the top surface of the base, when sufficient force is applied said thereto.

15. The wedge leveling system of claim 14, wherein said vertical member includes an expanded top portion and a beveled second opening formed therein, above the first opening, to allow easy gripping and for holding identifying matter.

16. The wedge leveling system of claim 15, further including a wedge adapted to be inserted and held in the first opening in the vertical member where it presses down the adjacent surface coverings toward a surface upon which they are being laid, to properly align the edges thereof until the adjacent surface coverings are set; and said wedge including an angled top surface with a plurality of ribs formed thereon; and the top edge of the at least one opening being formed as a knife edge for cooperating with the plurality of ribs formed on the angled top surface of the wedge.

* * * * *